US010981026B2

(12) United States Patent
Sudeith et al.

(10) Patent No.: US 10,981,026 B2
(45) Date of Patent: Apr. 20, 2021

(54) CLIMBING WALL WITH ROTATABLE OBSTACLES

(71) Applicant: Everlast Climbing Industries, Inc., Minneapolis, MN (US)

(72) Inventors: Timothy S. Sudeith, Edina, MN (US); Sarah Howard, Lakeville, MN (US)

(73) Assignee: EVERLAST CLIMBING INDUSTRIES, INC., Minneapolis, MN (US)

( * ) Notice: Subject to any disclaimer, the term of this patent is extended or adjusted under 35 U.S.C. 154(b) by 107 days.

(21) Appl. No.: 16/020,488

(22) Filed: Jun. 27, 2018

(65) Prior Publication Data

US 2018/0369630 A1 Dec. 27, 2018

Related U.S. Application Data

(60) Provisional application No. 62/525,343, filed on Jun. 27, 2017.

(51) Int. Cl.

| | |
|---|---|
| ***A63B 9/00*** | (2006.01) |
| ***A63B 71/02*** | (2006.01) |
| ***A63B 69/00*** | (2006.01) |
| ***A63B 71/06*** | (2006.01) |
| ***A63B 63/00*** | (2006.01) |

(Continued)

(52) U.S. Cl.

CPC ..... *A63B 9/00* (2013.01); *A63B 69/0048* (2013.01); *A63B 71/02* (2013.01); *A63B 43/005* (2013.01); *A63B 63/00* (2013.01); *A63B 63/003* (2013.01); *A63B 63/06* (2013.01); *A63B 63/08* (2013.01); *A63B 69/0057* (2013.01);

(Continued)

(58) Field of Classification Search

CPC ..... A63B 9/00; A63B 69/0048; A63B 71/02; A63B 43/005; A63B 63/00; A63B 63/003; A63B 63/06; A63B 63/08; A63B 69/0057; A63B 71/06; A63B 71/0622; A63B 2067/061; A63B 2071/0625; A63B 2207/02; A63B 2208/12; A63B 2209/10; A63B 2225/09

See application file for complete search history.

(56) References Cited

U.S. PATENT DOCUMENTS 6,609,689 B1 * 8/2003 Knapp ..... A47K 5/04 248/205.5

7,419,457 B1 9/2008 Sudeith et al.

(Continued)

OTHER PUBLICATIONS https://www.youtube.com/watch?v=nm6udyVo7uk; Everlast Climbing; Jun. 14, 2017.*

(Continued)

*Primary Examiner* — Nyca T Nguyen
*Assistant Examiner* — Andrew M Kobylarz
(74) *Attorney, Agent, or Firm* — McAndrews, Held & Malloy, Ltd.

(57) ABSTRACT

Embodiments of the present disclosure provide a system for the mounting of obstacles on a climbing wall in a manner which allows the obstacles to take on a number of different positions or orientations without a need to remove the obstacle mounting element from the climbing surface or perform any other significant disassembly. Embodiments of the present disclosure thus provide obstacles that can be repositioned by children during play to instantly create a variety of unique climbing challenge courses.

18 Claims, 12 Drawing Sheets

(51) Int. Cl.

| | |
|---|---|
| ***A63B 63/08*** | (2006.01) |
| ***A63B 43/00*** | (2006.01) |
| ***A63B 67/06*** | (2006.01) |
| ***A63B 63/06*** | (2006.01) |

(52) U.S. Cl.
CPC ..... *A63B 71/06* (2013.01); *A63B 71/0622* (2013.01); *A63B 2067/061* (2013.01); *A63B 2071/0625* (2013.01); *A63B 2208/12* (2013.01); *A63B 2209/10* (2013.01); *A63B 2225/09* (2013.01); *A63B 2225/74* (2020.08)

(56) References Cited

U.S. PATENT DOCUMENTS

| | | | | |
|---|---|---|---|---|
| 2006/0116244 | A1* | 6/2006 | Postma ..... | A63B 69/0048 482/37 |
| 2007/0240281 | A1* | 10/2007 | Meissner ..... | A63B 69/0048 16/108 |
| 2014/0323274 | A1* | 10/2014 | Moy ..... | A63B 69/0048 482/37 |
| 2015/0343288 | A1* | 12/2015 | Taggart ..... | A63B 69/0048 482/37 |
| 2017/0050097 | A1* | 2/2017 | Matys ..... | A63B 69/0048 |

OTHER PUBLICATIONS

Website—https://everlastclimbing.com/products/climbing-wall-challenge-course.
Website—https://www.atomikclimbingholds.com/obstaclechallengecourseclimbingholds.

* cited by examiner

CLIMBING WALL WITH ROTATABLE OBSTACLES

This application claims priority to U.S. Provisional Patent Application No. 62/525,343, filed on Jun. 27, 2017, the entirety of which is incorporated by reference herein.

SUMMARY OF THE INVENTION

Embodiments of the present disclosure are directed to rotatable obstacle holders for mounting on climbing walls and climbing walls comprising rotatable obstacles holders.

The mounting of obstacles (such as rings to climb through, barriers, and the like) to a climbing wall in order to create a challenge course is known. However, in conventional climbing wall challenge courses, the positioning of the obstacles cannot be changed without disassembling the challenge course and rebuilding it in a different configuration, which is a significant undertaking. Accordingly, it is easy for children's interest in a particular climbing challenge course to wane due to the lack of new and interesting challenges.

Embodiments of the present disclosure provide a convenient system for the repositioning of obstacles, which does not require removing the obstacle mounting element from the climbing surface or any other disassembly. Embodiments of the present disclosure thus provide obstacles that can be repositioned by children during play to instantly create a variety of unique climbing challenge courses.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Embodiments of the present disclosure are directed to obstacle holders configured for mounting to climbing walls and climbing walls having one or more obstacle holders mounted thereon.

Figure 1:
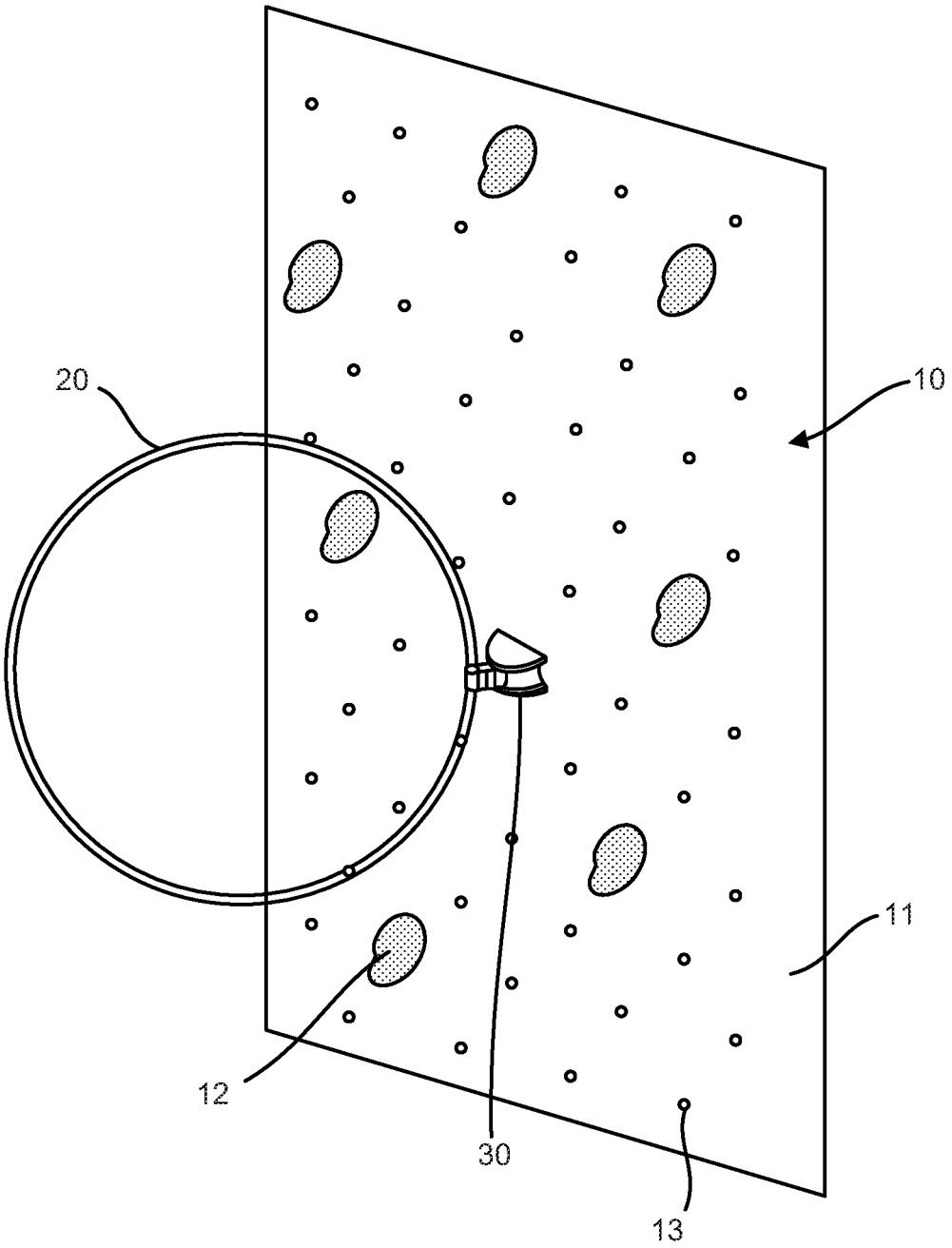
FIG. 1 is a front perspective view of an embodiment of a climbing wall of the present disclosure, showing an obstacle mounted to the climbing wall by an embodiment of a rotatable obstacle holder.

FIG. 1 shows an example of a climbing wall 10 comprising an obstacle 20. The obstacle 20 is attached to the climbing wall 10 by an obstacle holder 30 in accordance with an embodiment of the present disclosure. The climbing wall 10 comprises a climbing surface 11, which includes a plurality of climbing grips 12. The climbing grips 12 may be attached to the climbing surface 11 through conventional means that are understood by those of skill in the art. In some embodiments, for example, the climbing surface 11 comprises a plurality of apertures 13 that define potential mounting locations for a climbing grip 12. The climbing wall 10 may be made up of one or more climbing panels, which may be mounted side-by-side (such as for a traverse wall) and/or vertically. In some embodiments, the climbing panels may also form angles with one another to create a non-planar climbing surface 11.

The obstacle 20 shown in FIG. 1 is a ring that is sized and configured for a user to climb through. In some embodiments, hoops, for example hula hoops, may be used as obstacles 20. The hoops may be of a variety of different sizes and are not limited to the illustrated embodiments. Obstacles 20 that may be attached to a climbing wall 10 through embodiments of the present disclosure also include non-circular elements configured for a user to climb through, hurdles configured for a user to climb over, barriers that are configured to prevent a user from climbing in a particular pathway, and the like.

In some embodiments, for instance, the obstacle may comprise a straight rod, a rod having multiple portions in angled relationship to one another (e.g. an L-shaped rod or a V-shaped rod), or a curved rod (e.g. a U-shaped or C-shaped rod). Using the embodiment of an obstacle holder 30 shown in FIG. 1, for example, a first portion of an L-shaped rod could be held by the obstacle holder so as to be parallel or substantially parallel with the climbing surface 11, with a second portion of the L-shaped rod extending away from the climbing surface in any of a variety of angles. Alternatively or additionally to allowing for obstacles to be placed at different angles, the distance of an obstacle, such as a rod, from the climbing surface 11 may be varied using embodiments of the obstacle holders described herein, including for instance the embodiment shown in FIG. 1.

The obstacles 20 may also include activities mounted to the climbing surface 11. For instance, the obstacles 20 may also include rings or the like configured for users to toss a ball (or similar toy such as a beanbag) though, openings configured for users to toss a ball into, targets configured for users to toss a ball at, flag holders, or the like. For example, one or more of the obstacles 20 may comprise a target comprising a hook and loop fastener such as Velcro, or a similar reusable adhering mechanism, to which a ball comprising Velcro or the like may "stick". Using embodiments of the obstacle holders 30 disclosed herein, these types of obstacles may be moved or rotated to alter the difficulty level associated with the obstacle.

In some embodiments, at least one of the obstacle 20 and the obstacle holder 30 may also comprise an indicator element, such as a light (e.g. LED light, etc.) or a noise-making device (e.g. bell, buzzer, horn, speaker, etc.), configured to indicate any of the following: a hoop or rod has been touched with a sufficient force to activate the indicator, a ball has been tossed through the obstacle, a ball has been tossed into the obstacle, a ball has struck an obstacle target, a flag has been removed from the obstacle, a flag has been inserted into the obstacle, or the like.

The obstacles may be made out of a variety of different materials. For instance, the obstacles may be rigid or flexible. In some embodiments, one or more of the obstacles may be made out of a soft or foamed material, such as that used in pool noodles. One or more of the obstacles may also be made of a more rigid plastic material. One or more of the obstacles may also be made of a cloth material.

The obstacle holder 30 may comprise at least a base 31 and a component 32 configured to hold an obstacle 20. In alternative embodiments, the obstacle holder 30 may comprise at least a base 31 and an obstacle 20 that is coupled directly to the base, optionally in a rotatable manner. The base 31 is configured to mount to a climbing surface 11. The base may be configured to mount to a climbing surface 11 through any of the means that are understood by those of skill in the art for the mounting of climbing grips 12. For example, the base 31 may comprise an aperture through which a fastener (such as a bolt, a screw, etc.) may be inserted. The fastener may be inserted through a rear surface of the base and into one of the plurality of apertures 13 in the climbing surface, thereby securing the base 31 to the climbing surface 11. For instance, the base 31 may be configured to be secured to the climbing surface 11 with a standard T-nut mating system. In some embodiments, the base 31 may be placed at a desired orientation on the climbing surface 11 prior to securement (i.e. a surface of the base may serve as the top surface, the bottom surface, or a side surface depending on how the base is oriented prior to securement). The base 31 may take on any of a variety of configurations. In some embodiments, the base 31 may be configured to serve as a climbing grip 12 when no obstacle 20 is in use and/or when component 32 is removed.

The component 32 comprises at least one element configured to hold an obstacle 20. In the embodiment shown in FIG. 2, for example, the component 32 comprises a clasp 33 that is sized to grip an obstacle 20. The clasp 33 in the embodiment shown in FIG. 2 comprises flexible arms that serve to hold the obstacle 20 by a friction-fit. For instance, insertion of the obstacle 20 causes the flexible arms to spread apart until the obstacle is positioned within the central aperture of the clasp 33, at which point the flexible arms snap into their rest position, such that the arms at least partially surround and grip the obstacle. The clasp 33 may be configured such that the type of force that may occur if a child attempts to use the obstacle 20 to suspend his or herself or if a child falling off the climbing wall 10 interacts with the obstacle 20 will cause the obstacle 20 to automatically dislodge from the clasp 33. The clasp 33 may be configured such that a desired minimum amount of force is required to dislodge the obstacle 20 from the clamp.

Figure 2:
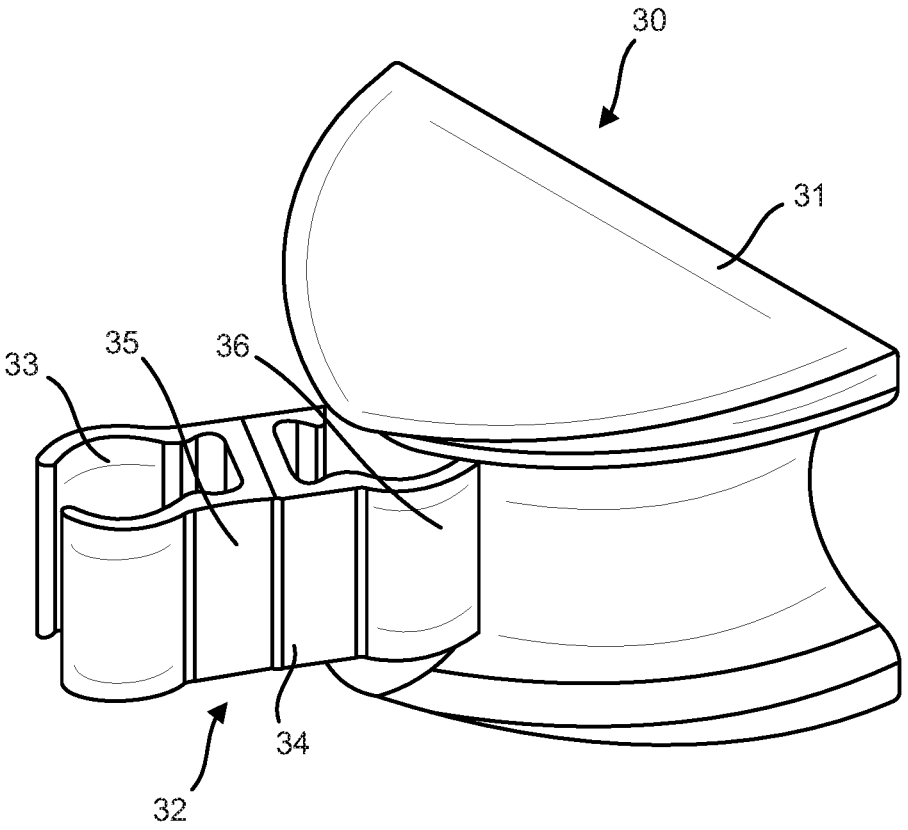
FIG. 2 is a front perspective view of an embodiment of a rotatable obstacle holder.
Figure 3:
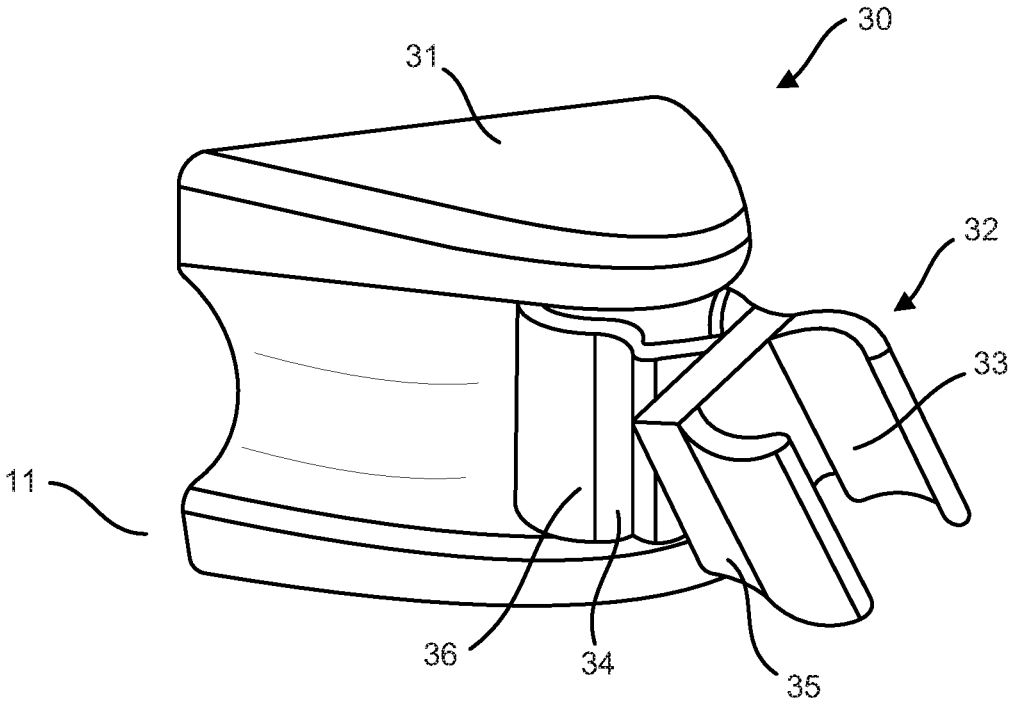
FIG. 3 is a front perspective view of the rotatable obstacle holder of FIG. 2 mounted to a climbing surface.

A clasp 33 like the one shown in FIG. 2 may have a variety of dimensions depending on the obstacle 20 that the holder 30 is configured to hold. For example, the embodiment of an obstacle holder 30 shown in FIGS. 8-10 comprises a similar clasp 33 to that shown in FIG. 2, but having a significantly greater length. A clasp 33 having a greater length may be useful for obtaining a more secure grip on the obstacle 20.

In other embodiments, the clasp 33 may be configured to hold a variety of obstacles 20 of different dimensions. For instance, in some embodiments, the clasp 33 may be controllable by a user to form an aperture having a variety of different cross-sectional areas. In some embodiments for example, a user may control the distance between arms of the clasp 33, i.e. the width of the aperture, by tightening a fastener, such as by turning a knob, pressing a lever, or the like. Using this embodiment, a user may loosen the fastener to create a relatively wide aperture, insert an obstacle 20 into the relatively wide aperture, and then tighten the fastener to bring the arms of the clasp 33 together so as to grip the obstacle.

In some embodiments, the component 32 may be configured to hold more than one obstacle 20. For example, the component 32 may comprise a plurality of elements configured to hold obstacles 20, such as a plurality of clasps 33. Alternatively, the component 32 may comprise a single element that is configured to hold multiple obstacles 20. In some embodiments, for instance, the component 32 may comprise a Y-shape, with each of two ends of the Y-shaped structure being configured to hold an obstacle 20. In some embodiments, the obstacle holder 30 may comprise more than one component 32, with each component 32 holding one or more obstacles 20.

At least a portion of the obstacle holder 30 may be configured to rotate so that the obstacle 20 can be repositioned without removing either the obstacle or any part of the obstacle holder from the climbing surface 11. In some embodiments, for example, the component 32 may comprise multiple portions, with at least one of the portions being rotatably coupled to another of the portions. In some embodiments, the component 32 may be rotatably coupled to the base 31. In other embodiments, the base 31 itself may be rotatably coupled to the climbing surface 11.

In the embodiment shown in FIGS. 2-5, the component 32 comprises a first portion 34 and a second portion 35, in which the second portion is rotatable about the first portion.

The first portion 34 comprises an element 36 for attaching the component to the base 31. For instance, as shown in the illustrated embodiment, the first portion 34 may comprise a clip that is configured to clip onto a portion of the base 31.

The first portion 34 may be configured to be releasably attached to the base 31. In the embodiment shown in FIG. 2, for instance, the clip may easily be attached to and removed from the base 31. The clip may be configured such that the type of force that may occur if a child attempts to use the obstacle 20 to suspend his or herself or if a child falling off the climbing wall 10 interacts with the obstacle 20 will cause the component 32 to automatically release from the base 31. The clip may be configured such that a desired minimum amount of force is required to release the component 32 from the base 31.

In other embodiments, the first portion 34 may be secured to the base, such as by element 36 alone or in conjunction with one or more fasteners. In other embodiments, the first portion 34 may be integral with the base 31 (in which case, component 32 may be rotatably mounted directed to the base).

The second portion 35 comprises an element configured to grip the obstacle 20. For instance, as shown in the illustrated embodiment, the second portion 35 may comprise clasp 33. To provide for repositioning of the obstacle 20, the second portion 35 may be rotatably connected to the first portion 34. Rotation of the second portion 35 about the first portion 34 is seen by comparing FIGS. 2 and 3. In some embodiments, the second portion 35 may be fully rotatable, i.e. rotatable through 360°. In other embodiments, the second portion 35 may be partially rotatable, i.e. rotatable through less than 360°. For instance, in some embodiments, the second portion 35 may be rotatable 45° or more, alternatively the second portion may be rotatable 90° or more, alternatively the second portion may be rotatable 180° or more.

In some embodiments, the second portion 35 may rotate freely upon the application of force but be maintained in a selected position when the application of force is removed. For instance, the second portion 35 may be configured so that a user may easily rotate the obstacle to a desired position but that, once the desired position is achieved, a user may simply let go of the obstacle and the obstacle will remain in the selected position. This may be achieved, for instance, by careful configuration of the amount of tension between the first portion 34 and the second portion 35. Some embodiments may also comprise a locking element 37 that serves to prevent rotation of the second portion 35. For instance, once a desired position is obtained, a user may activate a locking element 37, thereby preventing further rotation of the second portion 35. The locking element 37 may be activated through any of a number of mechanisms, such as by turning a knob, moving a lever, flipping a switch, etc.

Rotation of the second portion 35 about the first portion 34 may be defined by an axis of rotation 40. In some embodiments, the obstacle holder 30 may only have a single axis of rotation. For example, if component 32 may only be attached to the base 31 in a single orientation, then the obstacle holder 30 will only have a single axis of rotation 40.

In the embodiment illustrated in FIG. 2, for example, the component 32, and more particularly the first portion 34 of the component, may only be attached to the tip of the base 31 so as to extend directly away from the climbing surface 11. Accordingly, the rotation axis 40 is substantially perpendicular with the climbing surface 11. This relationship is illustrated for example in FIG. 4. For purposes of defining the rotation axis 40, as used herein, climbing surface 11 refers to the portion of the climbing surface to which the obstacle holder 30 is mounted (which may be relevant where, for example, the climbing surface 11 as a whole may be non-planar).

In other embodiments, the component 32, and more particularly the first portion 34 of the component, may be attached to the base 31 to define a rotation axis 40 that is angled at an angle α with respect to the climbing surface 11. For example, in some embodiments, the first portion 34 of the component 32 may be attached to the base 31 to extend at an angle with the climbing surface 11, thereby defining a rotation axis 40 of angle α with respect to the climbing surface. In the embodiment illustrated in FIG. 4, the angle α is about 90° (i.e. the rotation axis 40 is substantially perpendicular to the climbing surface 11). In other embodiments, however, the angle α may be between 5° and 175°, alternatively between 15° and 165°, alternatively between 30° and 150°, alternatively between 45° and 135°, alternatively between 60° and 120°, alternatively between 75° and 105°.

Figure 4:
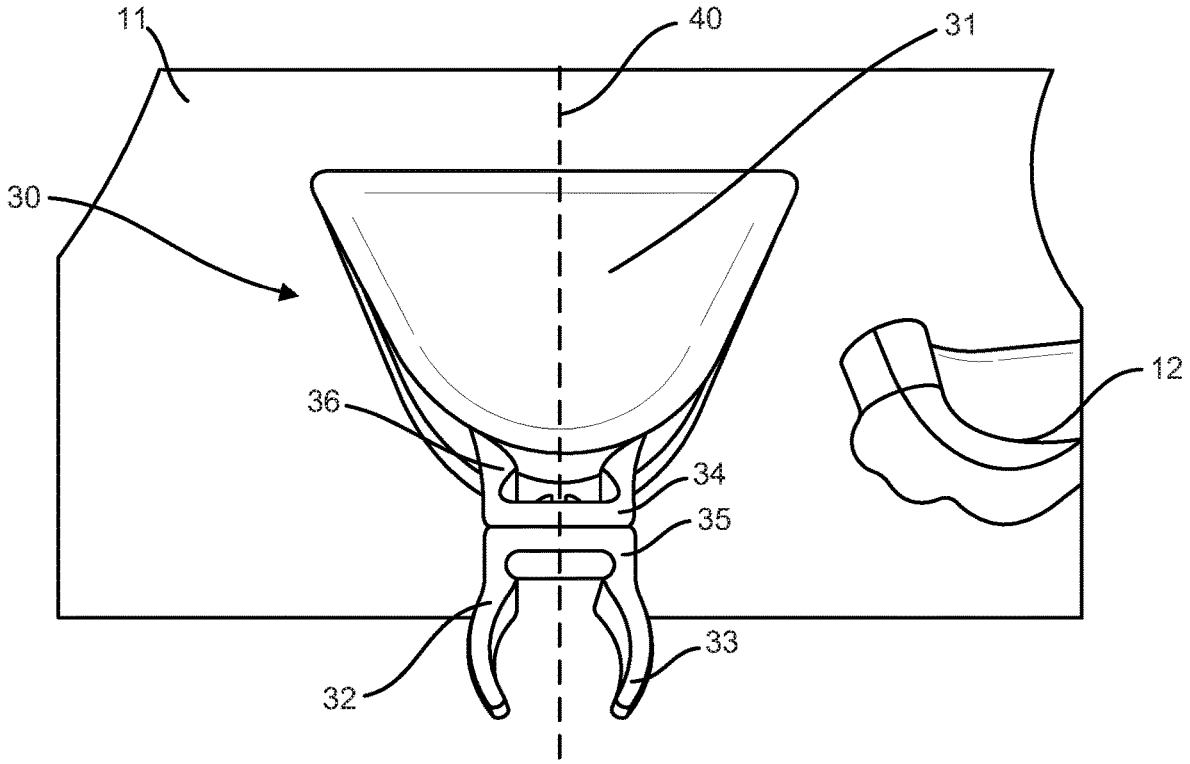
FIG. 4 is a top plan view of the rotatable obstacle holder of FIG. 2 mounted to a climbing surface.

In other embodiments, the obstacle holder 30 may be configured so that the first portion 34 may be attached to the base 31 in a number of positions, such that the angle α formed by the rotation axis 40 and the climbing surface may be selected from among a plurality of possible angles. For example, in some embodiments, the first portion 34 of the component 32 may be attached to the base 31 to extend directly away from the climbing surface 11, as shown in FIG. 4, or the first portion of the component may be attached to the base so as to extend from the base at one or more angles from the climbing surface (e.g. about 75°, about 60°, and/or about 45°). The one or more angles α may be between 5° and 175°, alternatively between 15° and 165°, alternatively between 30° and 150°, alternatively between 45° and 135°, alternatively between 60° and 120°, alternatively between 75° and 105°.

In other embodiments, the first portion 34, while remaining attached to the base 31, may be movable to a number of positions, such that the angle α formed by the rotation axis 40 and the climbing surface may be selected from among a plurality of possible angles. For example, in some embodiments, the first portion 34 of the component 32 may extend directly away from the climbing surface 11, as shown in FIG. 4, or the first portion of the component may be swiveled so as to extend from the base at one or more angles from the climbing surface (e.g. about 75°, about 60°, and/or about 45°). The one or more angles α may be between 5° and 175°, alternatively between 15° and 165°, alternatively between 30° and 150°, alternatively between 45° and 135°, alternatively between 60° and 120°, alternatively between 75° and 105°.

Figure 11:
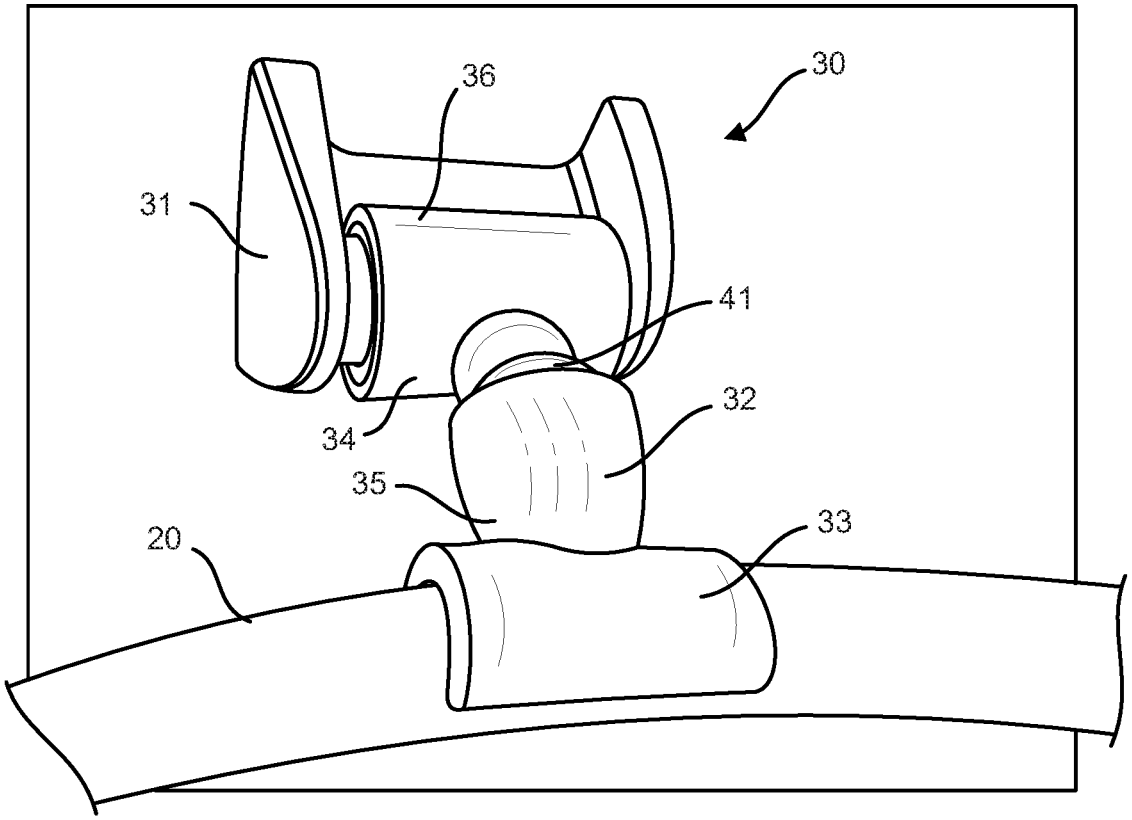
FIG. 11 is a first perspective view of another embodiment of a rotatable obstacle holder.
Figure 12:
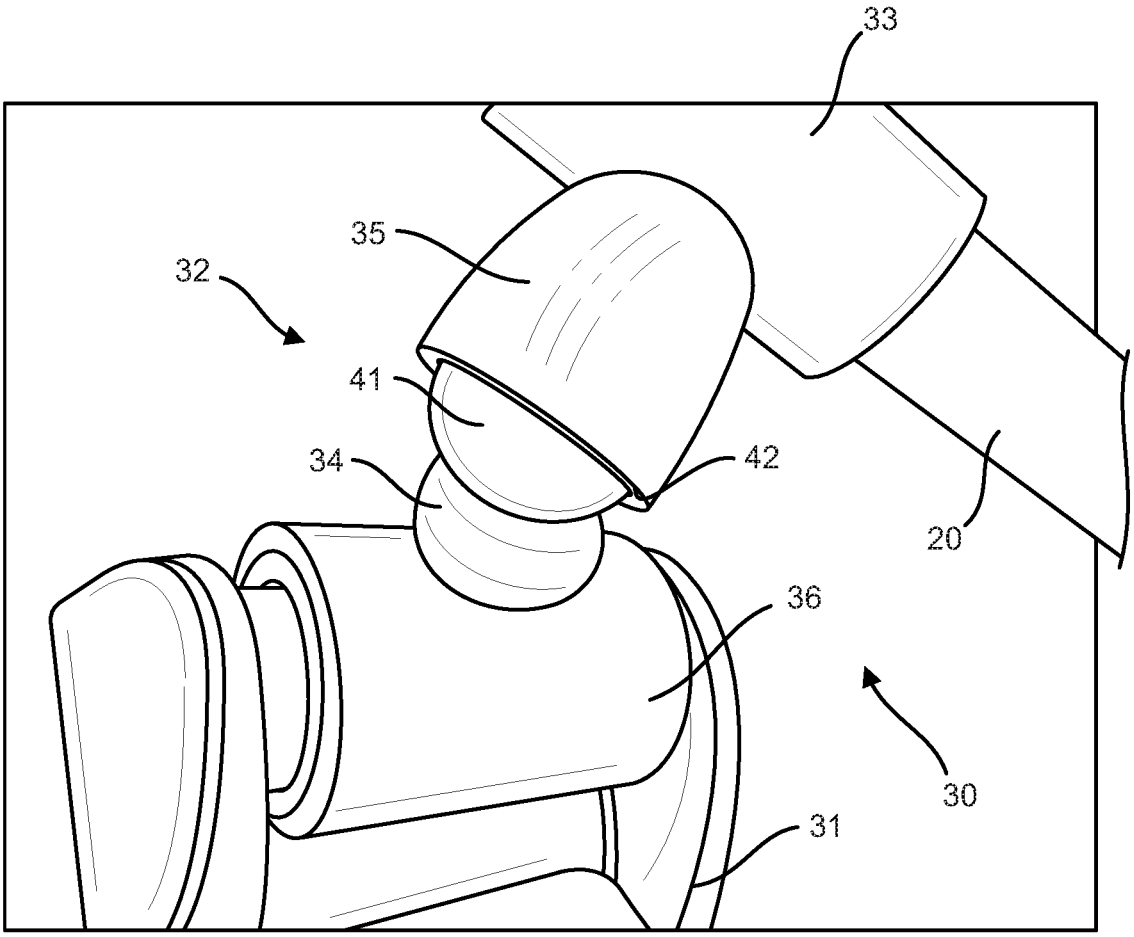
FIG. 12 is a second perspective view of the rotatable obstacle holder of FIG. 11, in which the obstacle has been rotated to a different position.
Figure 13:
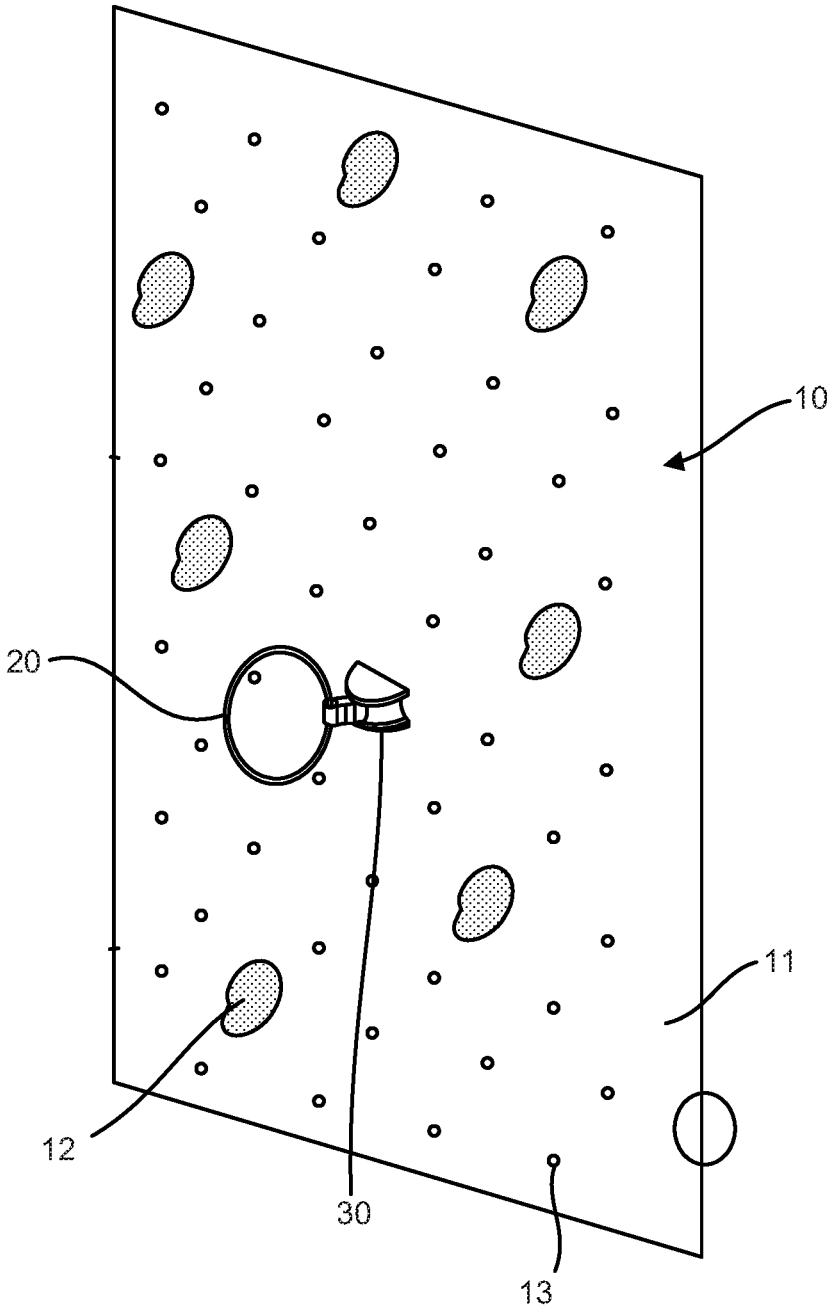
FIG. 13 is a front perspective view of an embodiment of a climbing wall of the present disclosure, showing an obstacle mounted to the climbing wall by an embodiment of a rotatable obstacle holder, the obstacle comprising an element configured for receiving a ball.

FIGS. 11-12 show another embodiment in which component 32 comprises a first portion 34 and a second portion 35, and where the second portion is rotatable about the first portion. The first portion 34 of the component comprises an element 36 for attaching the component to the base 31. For instance, as shown, the first portion 34 may comprise a clip that is configured to clip onto a portion of the base 31.

The first portion 34 may be configured to be releasably attached to the base 31. In the embodiment shown in FIGS. 11-12, for instance, the clip may easily be attached to and removed from the base 31. The clip may be configured such that the type of force that may occur if a child attempts to use the obstacle 20 to suspend his or herself or if a child falling off the climbing wall 10 interacts with the obstacle 20 will cause the component 32 to automatically release from the base 31. The clip may be configured such that a desired minimum amount of force is required to release the component 32 from the base 31.

In other related embodiments, the first portion 34 may be secured to the base, such as by element 36 alone or in conjunction with one or more fasteners. In yet other related embodiments, the first portion 34 may be integral with the base 31 (in which case, component 32 may be rotatably mounted directed to the base).

In the embodiment illustrated in FIGS. 11-12, the second portion 35 is rotatably mounted on the first portion 34 by a ball and socket mechanism. As illustrated, the first portion 34 may comprise a spherical end element 41 upon which the second portion 35 may rotate. In related embodiments, the first portion 34 may comprise a semi-spherical end element, such as a half-sphere, or an end element having a curved surface.

The second portion 35 comprises an element configured to grip the obstacle 20. For instance, as shown in the illustrated embodiment, the second portion 35 may comprise clasp 33. To provide for repositioning of the obstacle 20, the second portion 35 may be rotatably connected to the first portion 34. For instance, the second portion 35 may comprise an aperture 42 sized and configured to receive the spherical (or otherwise curved) end element 41 and thus be rotatably mounted thereon, with the aperture of the second portion being rotatable about the spherical (or otherwise curved) surface of the end element.

In some embodiments, the second portion 35 may rotate freely upon the application of force but be maintained in a selected position when the application of force is removed. For instance, the second portion 35 may be configured so that a user may easily rotate the obstacle to a desired position but that, once the desired position is achieved, a user may simply let go of the obstacle and the obstacle will remain in the selected position. This may be achieved, for instance, by careful configuration of the fit between the end element 41 (of first portion 34) and the aperture 42 (of second portion 35). Some embodiments may also comprise a locking element 37 that serves to prevent rotation of the second portion 35. For instance, once a desired position is obtained, a user may activate a locking element 37, thereby preventing further rotation of the second portion 35. The locking element 37 may be activated through any of a number of mechanisms, such as by turning a knob, moving a lever, flipping a switch, etc.

In an alternative, and non-illustrated embodiment, the ball and socket connection may be reversed, such that the first portion 34 comprises the aperture 42 and the second portion 35 comprises the spherical (or otherwise curved) end element 41.

Figure 6:
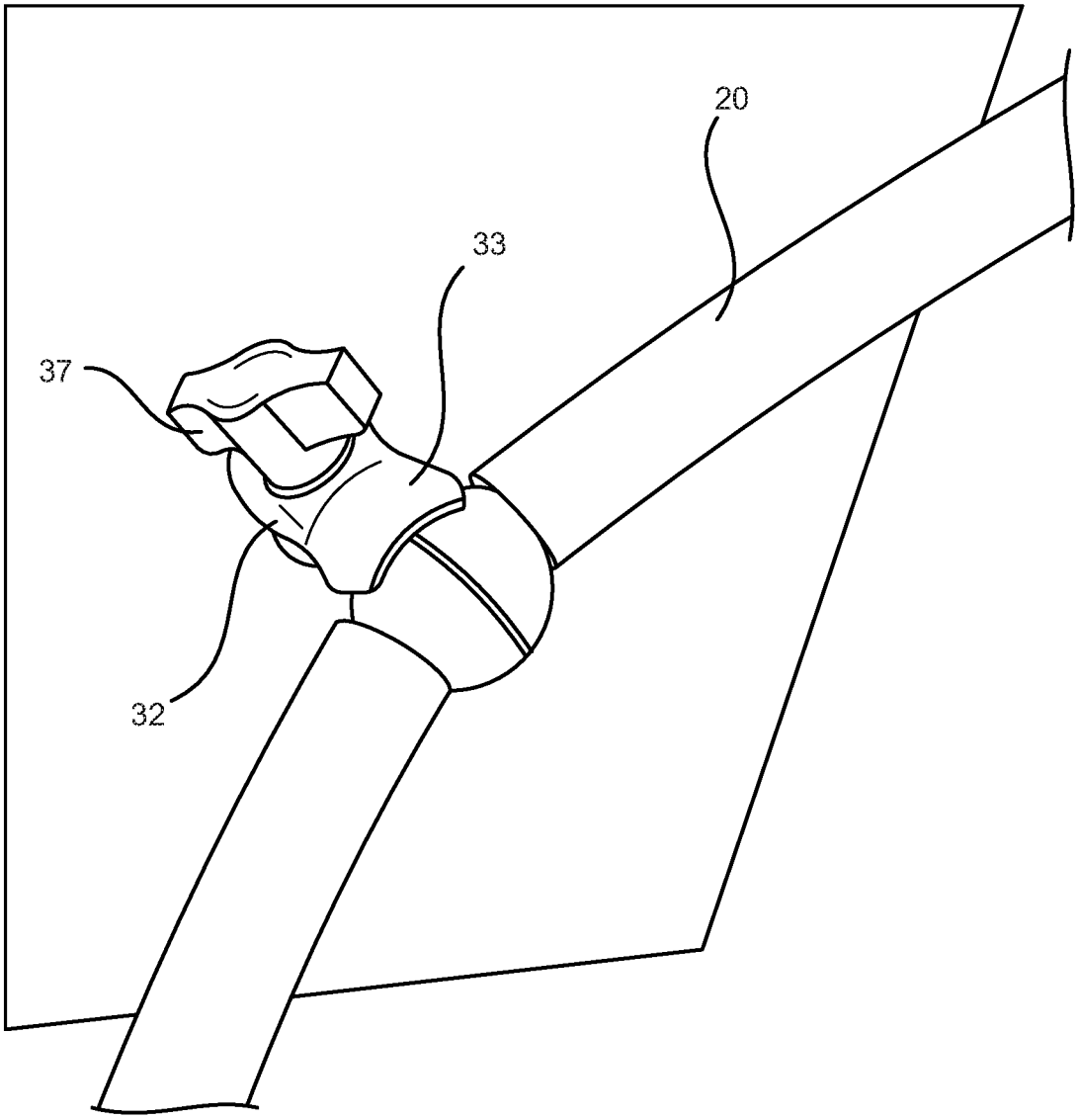
FIG. 6 is a front perspective view of another embodiment of a rotatable obstacle holder, shown holding an obstacle.
Figure 7:
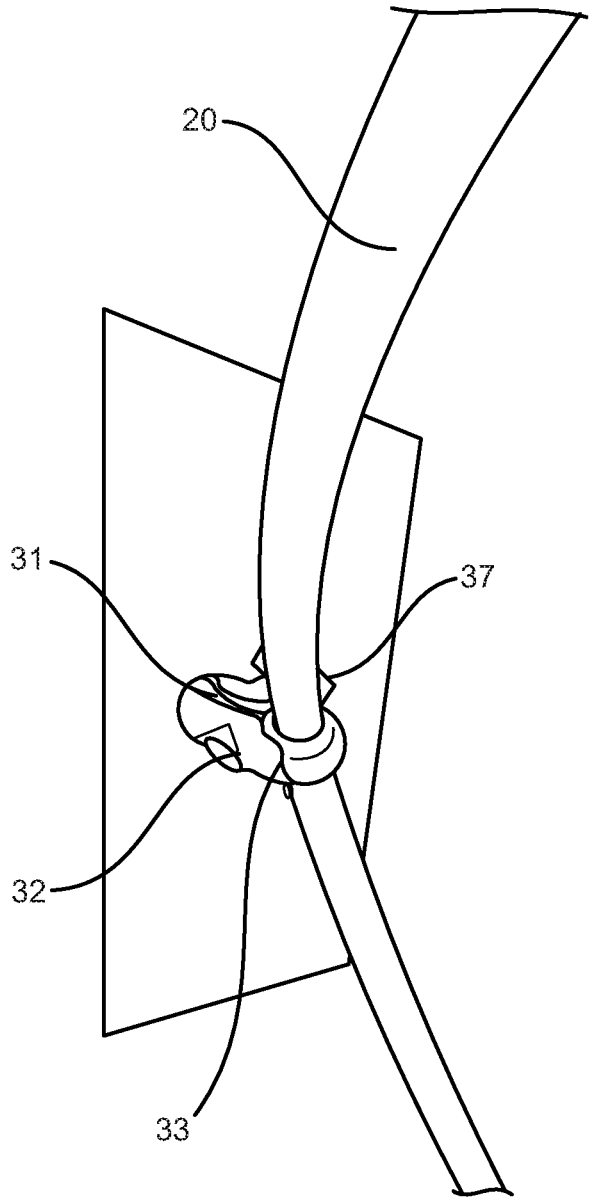
FIG. 7 is a front perspective view of the rotatable obstacle holder of FIG. 6, shown holding an obstacle.

In the embodiment shown in FIGS. 6-7, the component 32 is rotatably mounted to the base 31.

To provide for repositioning of the obstacle 20, the component 32 may be rotatably coupled to the base 31. Rotation of the component 32 about the base 31 is seen by comparing FIGS. 6 and 7. In some embodiments, the component 32 may be fully rotatable, i.e. rotatable through 360°. In other embodiments, the component 32 may be partially rotatable, i.e. rotatable through less than 360°. For instance, in some embodiments, the component 32 may be rotatable 45° or more, alternatively the component may be rotatable 90° or more, alternatively the component may be rotatable 180° or more.

In some embodiments, the component 32 may rotate freely upon the application of force but be maintained in a selected position when the application of force is removed. For instance, the component 32 may be configured so that a user may easily rotate the obstacle to a desired position but that, once the desired position is achieved, a user may simply let go of the obstacle and the obstacle will remain in the selected position. This may be achieved, for instance, by careful configuration of the amount of tension between the component 32 and the base 31. Some embodiments may also comprise a locking element 37 that serves to prevent rotation of the component 32. For instance, in the illustrated embodiment, once a desired position has been obtained, a user may activate locking element 37, thereby preventing further rotation of the component 32 on the base 31. The locking element 37 may be activated through any of a number of mechanisms, such as by turning a knob (as in the illustrated embodiment), moving a lever, flipping a switch, etc.

Rotation of the component 32 about the base 31 may be defined by an axis of rotation 40. In some embodiments, the obstacle holder 30 may only have a single axis of rotation. For example, if component 32 may only be attached to the base 31 in a single orientation, then the obstacle holder 30 will only have a single axis of rotation 40.

Figure 5:
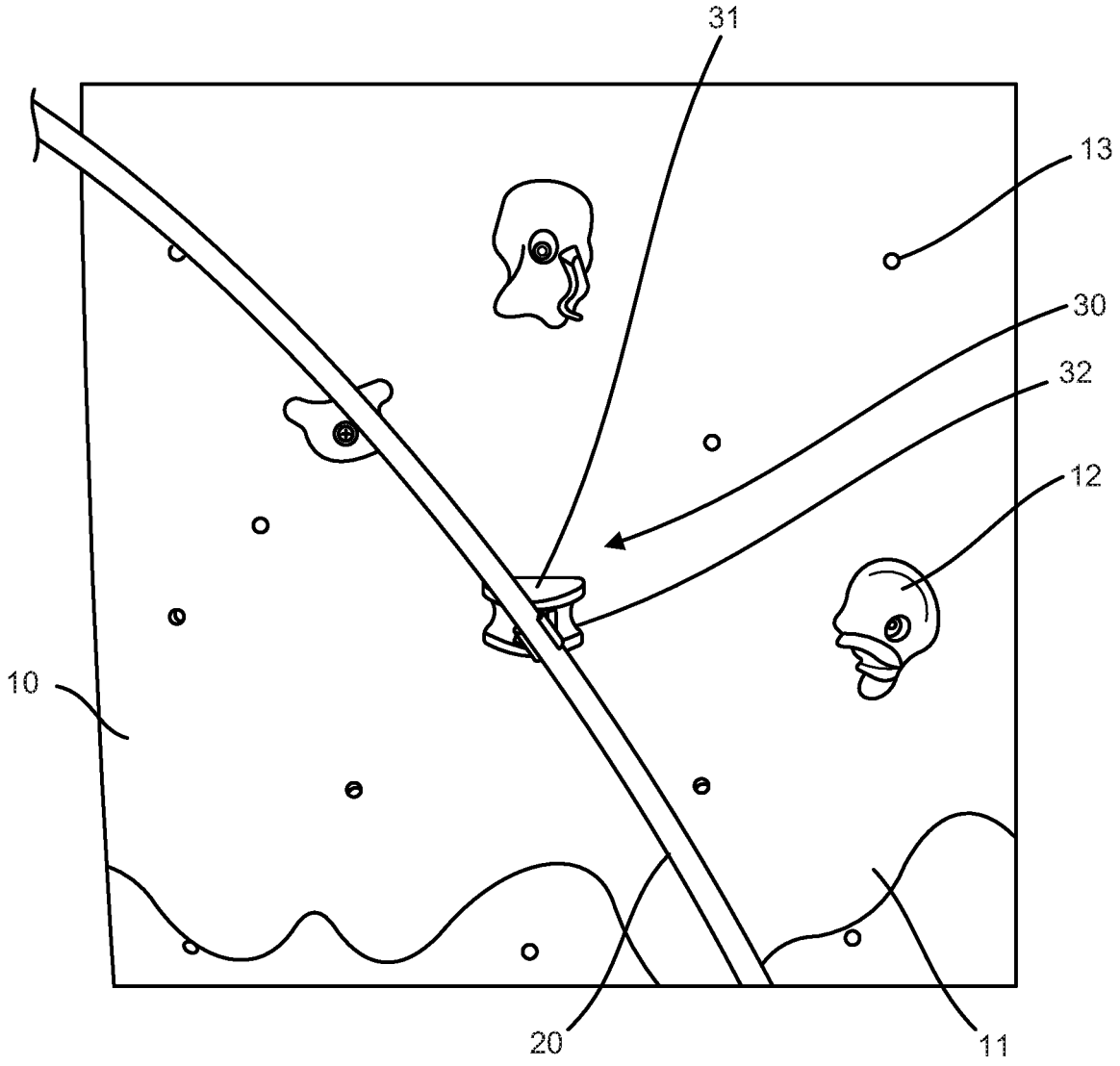
FIG. 5 is a front perspective view of the rotatable obstacle holder of FIG. 2 mounted to a climbing surface and holding an obstacle at a selected degree of rotation.

In the embodiment illustrated in FIGS. 5-6, for example, the component 32 may only be attached to the base 31 so as to extend directly away from the climbing surface 11. Accordingly, the rotation axis 40 is substantially perpendicular with the climbing surface 11. For purposes of defining the rotation axis 40, as used herein, climbing surface 11 refers to the portion of the climbing surface to which the obstacle holder 30 is mounted (which may be relevant where, for example, the climbing surface 11 as a whole may be non-planar).

In other embodiments, the component 32 may be coupled to the base 31 to define a rotation axis 40 that is angled at an angle $\alpha$ with respect to the climbing surface 11. For example, in some embodiments, the component 32 may be attached to the base 31 to extend at an angle with the climbing surface 11, thereby defining a rotation axis 40 of angle $\alpha$ with respect to the climbing surface. In the illustrated embodiment, the angle $\alpha$ is about 90° (i.e. the rotation axis 40 is substantially perpendicular to the climbing surface 11). In other embodiments, however, the angle $\alpha$ may be between 5° and 175°, alternatively between 15° and 165°, alternatively between 30° and 150°, alternatively between 45° and 135°, alternatively between 60° and 120°, alternatively between 75° and 105°.

In other embodiments, the obstacle holder 30 may be configured so that the component 32 may be attached to the base 31 in a number of positions, such that the angle $\alpha$ formed by the rotation axis 40 and the climbing surface may be selected from among a plurality of possible angles. For example, in some embodiments, the component 32 may be attached to the base 31 to extend directly away from the climbing surface 11, as shown in the illustrated embodiment, or the component may be attached to the base so as to extend from the base at one or more angles from the climbing surface (e.g. about 75°, about 60°, and/or about 45°). The one or more angles $\alpha$ may be between 5° and 175°, alternatively between 15° and 165°, alternatively between 30° and 150°, alternatively between 45° and 135°, alternatively between 60° and 120°, alternatively between 75° and 105°.

In other embodiments, the component 32, while remaining attached to the base 31, may be movable to a number of positions, such that the angle $\alpha$ formed by the rotation axis 40 and the climbing surface may be selected from among a plurality of possible angles. For example, in some embodiments, the component 32 may extend directly away from the climbing surface 11, as shown in the illustrated embodiment, or the component may be swiveled so as to extend from the base at one or more angles from the climbing surface (e.g. about 75°, about 60°, and/or about 45°). The one or more angles $\alpha$ may be between 5° and 175°, alternatively between 15° and 165°, alternatively between 30° and 150°, alternatively between 45° and 135°, alternatively between 60° and 120°, alternatively between 75° and 105°.

As described above, in some embodiments, the component 32 may swivel (also a manner of rotation) toward and away from the climbing surface 11 to form a variety of angles with respect to the climbing surface. In the embodiment shown in FIGS. 8-10, for instance, the component 32 swivels on the base 31, such that the clasp 33 may be moved toward and away from the climbing surface 11. Put another way, the component 32 rotates on the base 31 along a rotation axis 40 that is substantially parallel with the climbing surface 11.

Figure 8:
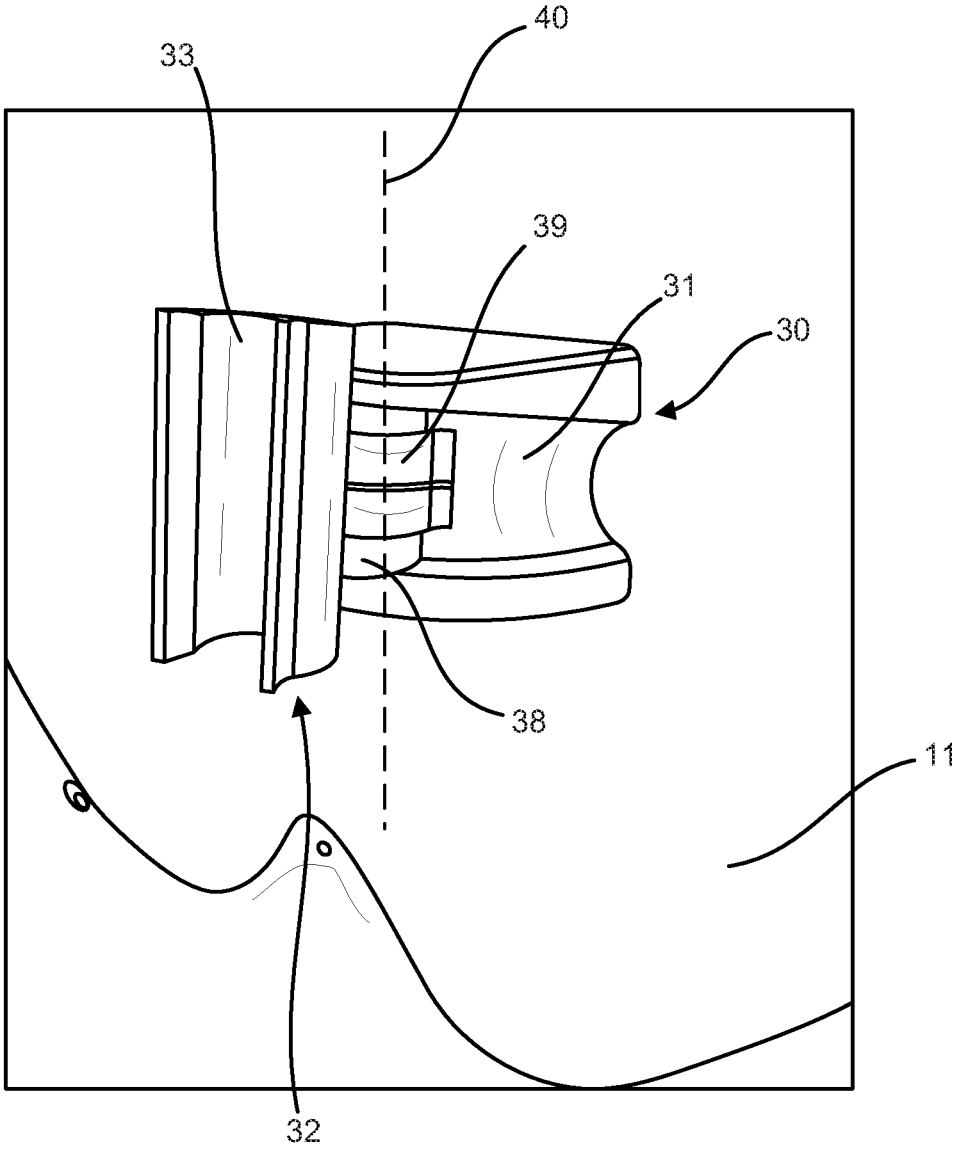
FIG. 8 is a front perspective view of another embodiment of a rotatable obstacle holder, shown mounted to a climbing surface.
Figure 9:
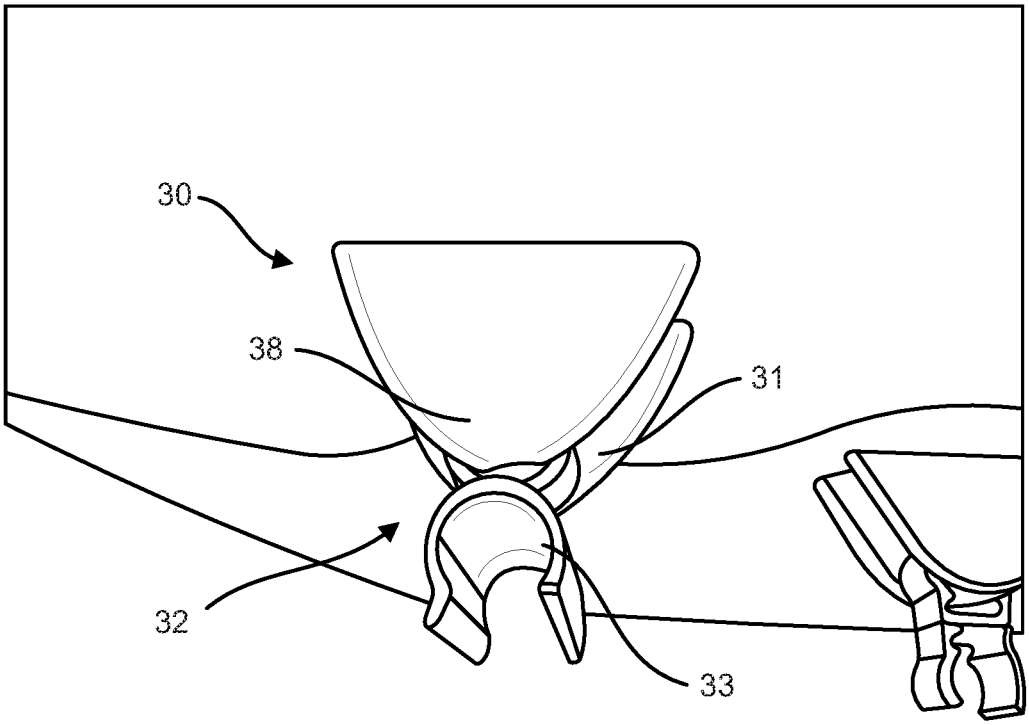
FIG. 9 is a top plan view of the rotatable obstacle holder of FIG. 8 mounted to a climbing surface.
Figure 10:
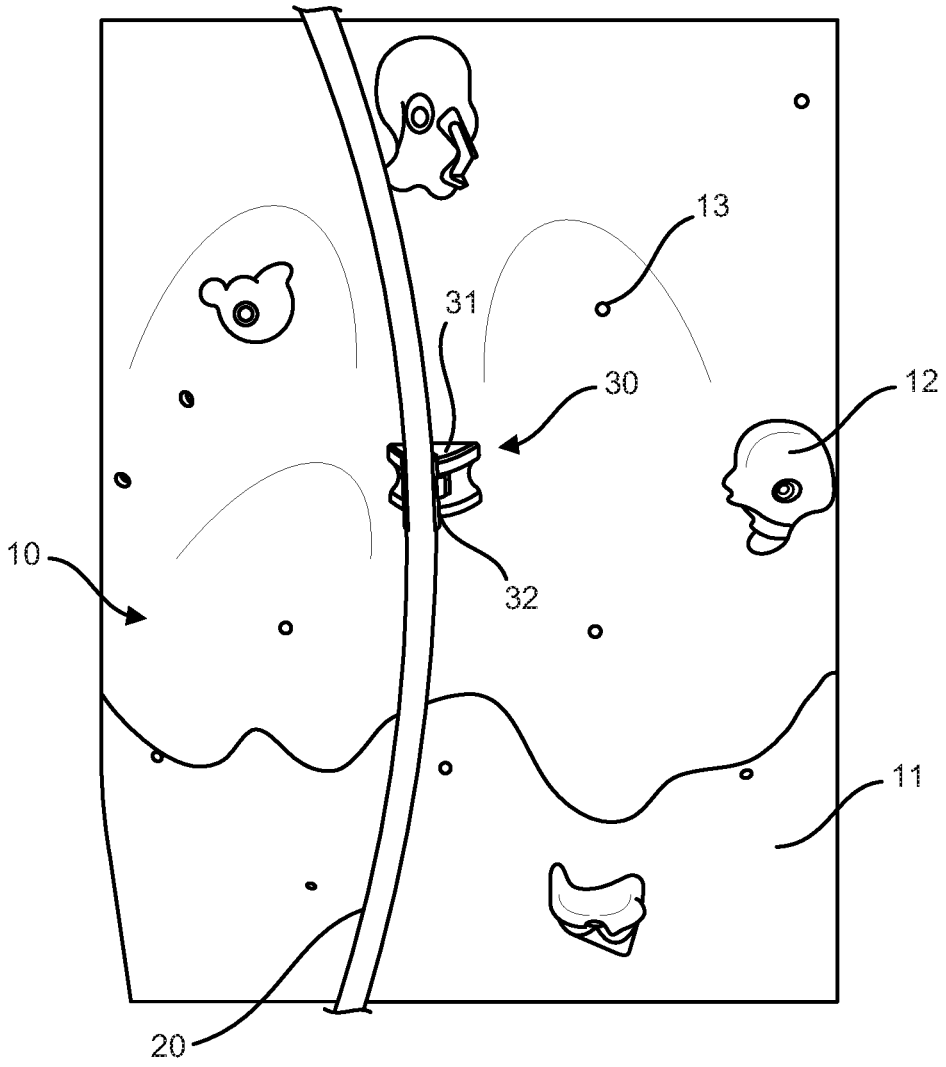
FIG. 10 is a front perspective view of the rotatable obstacle holder of FIG. 8 mounted to a climbing surface and holding an obstacle at a selected degree of rotation.

This swiveling places the clasp 33 at a variety of angles with respect to the climbing surface 11. In some embodiments, the component 32 may swivel such that the clasp 33 moves within a range of angles, relative to the climbing surface 11, between 5° and 175°, alternatively between 15° and 165°, alternatively between 30° and 150°, alternatively between 45° and 135°, alternatively between 60° and 120°, alternatively between 75° and 105°. Although FIGS. 8-10 show the obstacle holder 30 mounted on the climbing surface such that the swiveling of the component 32 occurs horizontally, the base 31 may also be mounted in a different orientation in order to cause the swiveling to occur in a vertical direction or diagonally across the climbing surface 11.

In the illustrated embodiment, the base 31 comprises a rounded element 38 that serves as a hinge pin and the component 32 comprises a hinge element 39 that rotates on the rounded element. In some embodiments, the component 32 may rotate freely upon the application of force but be maintained in a selected position when the application of force is removed. For instance, the component 32 may be configured so that a user may easily rotate the obstacle to a desired position but that, once the desired position is achieved, a user may simply let go of the obstacle and the obstacle will remain in the selected position. This may be achieved, for instance, by careful configuration of the amount of tension between the component 32 and the base 31, e.g. between the hinge pin 38 and the hinge element 39. Some embodiments may also comprise a locking element 37 that serves to prevent rotation of the component 32.

In some embodiments, the obstacle holder 30 may provide for rotation of the obstacle 20 along multiple axes. For example, in some embodiments, a first portion 34 of component 32 may swivel on the base 31 as described above (in relation to the embodiment illustrated in FIGS. 8-10) while the second portion 35 of the component rotates about the first portion (as described in relation to the embodiment illustrated in FIGS. 2-4). Alternatively, the base 31 could rotate with respect to the climbing surface 31 while the component 32 could swivel on the base. In yet other embodiments, the base 31 could rotate with respect to the climbing surface 11 while the component 32 could rotate with respect to the base. The rotation of the component 32 could be about a different rotation axis than the rotation of the base 31, due to the component extending at an angle from the base.

As described herein, in some embodiments, rotation of the obstacle 20 can be performed manually. In some embodiments, a climbing wall 10 may include a control unit that may be used to manually cause rotation of a plurality of obstacle holders 30. For instance, a plurality of obstacle holders 30 may be associated together and linked to a control device, such as a wheel or crank, which can be turned to cause the plurality of obstacle holders to rotate. Accordingly, one may create a whole new challenge course simply by activating a single control device. Alternatively, while one or more users attempt to navigate a challenge course, another individual may activate a control device to cause rotation of a variety of obstacles.

In other embodiments, rotation of the obstacle 20 may proceed for a limited time after being put into motion by a user. For instance, the climbing wall 10 may comprise a wheel or crank that may be turned, thereby "winding up" the one or more rotatable obstacle holders 30. When the wheel or crank is released, the one or more rotatable obstacle holders 30 may controllably unwind for a period of time. In this way, a user may power up a challenge course having a plurality of moving obstacles before each individual use (or during use by another individual).

In some embodiments, the rotation or rotations described herein can be performed in a wholly automatic manner. For instance, in some embodiments, the obstacle holder 30 may comprise a motor, the motor being configured to cause rotation of the obstacle 20 when activated. In some embodiments, a climbing wall 10 may comprise one or more motors that may be configured to operate one or more obstacle holders 30 that are associated together to form a system. For instance, a plurality of obstacle holders 30 may be connected to a motorized system such that activation of the system causes the plurality of obstacle holders 30 to rotate. In this manner, a challenge course having a plurality of moving obstacles may be activated by a simple button press, switch flip, or the like. The motor may be powered in any of a number of manners, including for example, by battery, a plug-in power source, or solar power. For instance, in some embodiments, the climbing wall 10 may comprise a solar panel associated with the one or more rotatable obstacle holders 30.

In some embodiments, the speed of the rotation may also be controlled. For instance, the system may comprise a speed control device, whereupon a user may set a rotation speed, and hence a difficulty level.

In many embodiments, including all of the illustrated embodiments, the obstacle holder 30 is configured to attach directly to a climbing surface. For instance, the obstacle holder 30 may comprise a rear surface configured to press against the climbing surface when the obstacle holder is mounted on the climbing wall. The obstacle holder 30 may also be configured to mount directly to the climbing wall through a conventional attachment mechanism, such as one configured to be secured with a standard T-nut mating system. For instance, the obstacle holder may comprise an aperture, such as a bore or through-hole, configured to receive a screw or bolt that extends through the rear surface and into the climbing wall.

In some embodiments, however, the obstacle holder 30 may be configured to attach to a conventional climbing hold, rather than directly to the wall itself. In this manner, an existing climbing hold can be converted to comprise one or more obstacles 20. For example, an embodiment of the obstacle holder 30 may comprise a rear surface that is configured to mate with or press against a conventional climbing hold. The obstacle holder 30 may also comprise a through-hole configured to receive a standard attachment mechanism by which the conventional climbing hold is attached to the wall. Using this embodiment, one may convert an existing climbing hold into an obstacle-bearing climbing hold simply by loosening or removing the attachment mechanism, e.g. bolt or screw, placing the attachment mechanism through the obstacle holder, and then tightening or re-installing the attachment mechanism so as to secure both (a) the conventional climbing hold to the wall and (b) the obstacle holder 30 to the conventional climbing hold. In yet other embodiments, the obstacle 20, itself, may be attached to a conventional climbing hold in the same manner (note that no obstacle holder 30 would be necessary in such an embodiment).

The term climbing wall should be considered to include climbing walls containing predominantly vertical climbing surfaces as well as climbing walls containing predominantly horizontal climbing surfaces, also sometimes referred to as a Traverse Wall®. Some climbing walls may also include various activities in addition to the climbing holds and climbing wall-mounted obstacles described herein, including for instance monkey bars or similar elements, rope elements, swinging (or otherwise movable) elements that must be traversed using one's hands and/or feet, cargo net elements, and the like.

It can be seen that the described embodiments provide a unique and novel climbing wall 10 that has a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A climbing wall comprising a. a climbing surface comprising a plurality of climbing grips; and b. an obstacle holder comprising i. a base mounted to the climbing surface, and ii. a component configured to hold an obstacle, wherein the obstacle holder comprises one or more rotatable elements configured so that the obstacle is configured to be repositioned without removing the obstacle or any part of the obstacle holder from the climbing surface; and wherein the component comprises a first portion attached to the base; and a second portion comprising a clasp configured to releasably hold the obstacle, the second portion being rotatably connected to the first portion.

2. The climbing wall of claim 1, wherein the obstacle is rotatable through at least 180°.

3. The climbing wall of claim 2, wherein the obstacle is rotatable through 360°.

4. The climbing wall of claim 1, wherein the component is rotatably mounted to the base.

5. The climbing wall of claim 1, wherein the base is rotatably mounted to the climbing surface.

6. The climbing wall of claim 1, wherein the component is attachable to the base in multiple positions, such that an axis of rotation is configured to be selected from a plurality of angles.

7. The climbing wall of claim 1, wherein the component is movable on the base, such that an axis of rotation is configured to be selected from a plurality of angles.

8. The climbing wall of claim 1, wherein rotation of the one or more rotatable elements occurs along a rotation axis that is substantially perpendicular with the climbing surface.

9. The climbing wall of claim 1, further comprising a locking element for preventing rotation of the one or more rotatable elements.

10. The climbing wall of claim 1, wherein the component is removable from the base.

11. The climbing wall of claim 1, further comprising the obstacle.

12. A climbing wall comprising a. a climbing surface comprising a plurality of climbing grips; and b. an obstacle holder comprising i. a base mounted to the climbing surface, and ii. a component configured to hold an obstacle, wherein the obstacle holder comprises one or more rotatable elements configured so that the obstacle is configured to be repositioned without removing the obstacle or any part of the obstacle holder from the climbing surface;

wherein the component configured to hold an obstacle comprises a clasp configured to releasably hold the obstacle; and wherein rotation of the one or more rotatable elements occurs along a rotation axis that is angled with respect to the climbing surface.

13. The climbing wall of claim 12, wherein the rotation axis is angled between 15° and 165° with respect to the climbing surface.

14. A climbing wall comprising a. a climbing surface comprising a plurality of climbing grips; and b. an obstacle holder comprising i. a base mounted to the climbing surface, and ii. a component configured to hold an obstacle, wherein the obstacle holder comprises one or more rotatable elements configured so that the obstacle is configured to be repositioned without removing the obstacle or any part of the obstacle holder from the climbing surface;

wherein the component configured to hold an obstacle comprises a clasp configured to releasably hold the obstacle; and wherein rotation of the one or more rotatable elements occurs along a rotation axis that is substantially parallel with the climbing surface.

15. A climbing wall comprising a. a climbing surface comprising a plurality of climbing grips; and b. an obstacle holder comprising i. a base mounted to the climbing surface, and ii. a component configured to hold an obstacle, wherein the obstacle holder comprises one or more rotatable elements configured so that the obstacle is configured to be repositioned without removing the obstacle or any part of the obstacle holder from the climbing surface; and c. the obstacle, wherein the obstacle comprises a hoop sized and configured for a user to climb through.

16. A climbing wall comprising a. a climbing surface comprising a plurality of climbing grips; and b. an obstacle holder comprising i. a base mounted to the climbing surface, and ii. a component configured to hold an obstacle, wherein the obstacle holder comprises one or more rotatable elements configured so that the obstacle is configured to be repositioned without removing the obstacle or any part of the obstacle holder from the climbing surface; and further comprising a motor configured to cause rotation of the one or more rotatable elements.

17. A climbing wall comprising a. a climbing surface comprising a plurality of climbing grips; and b. an obstacle holder comprising i. a base mounted to the climbing surface, and ii. a component configured to hold an obstacle, wherein the obstacle holder comprises one or more rotatable elements configured so that the obstacle is configured to be repositioned without removing the obstacle or any part of the obstacle holder from the climbing surface; and wherein the component configured to hold an obstacle comprises a clasp configured to releasably hold the obstacle; and c. the obstacle, wherein the obstacle comprises a rod sized and configured for a user to climb around.

18. A climbing wall comprising a. a climbing surface comprising a plurality of climbing grips; and b. an obstacle holder comprising i. a base mounted to the climbing surface, and ii. a component configured to hold an obstacle, wherein the obstacle holder comprises one or more rotatable elements configured so that the obstacle is configured to be repositioned without removing the obstacle or any part of the obstacle holder from the climbing surface; and wherein the component configured to hold an obstacle comprises a clasp configured to releasably hold the obstacle; and c. the obstacle, wherein the obstacle comprises an element configured for receiving a ball.

* * * * *